US005382000A

United States Patent [19]

Rossman

[11] Patent Number: 5,382,000

[45] Date of Patent: Jan. 17, 1995

[54] BOARD SETTING TOOL

[76] Inventor: Steven L. Rossman, 1305 W. Old Bay Rd., McHenry, Ill. 60050

[21] Appl. No.: 133,623

[22] Filed: Oct. 8, 1993

[51] Int. Cl.[6] ..... B66F 3/00

[52] U.S. Cl. ..... 254/17

[58] Field of Search ..... 254/15–17, 254/131, 11, 113, 119

[56] References Cited

U.S. PATENT DOCUMENTS

| | | | |
|---|---|---|---|
| 146,828 | 1/1874 | Ingrum | 254/15 |
| 338,933 | 3/1886 | Cloyd . | |
| 364,260 | 6/1887 | Kerns . | |
| 571,810 | 11/1896 | Tubbs . | |
| 634,561 | 10/1899 | Manwaring . | |
| 796,134 | 8/1905 | LeRoy . | |
| 815,064 | 3/1906 | Campbell . | |
| 1,060,843 | 5/1913 | Huston . | |
| 1,283,209 | 10/1918 | Kimble . | |
| 1,445,263 | 2/1923 | Asper . | |
| 1,665,430 | 4/1928 | Arzt | 254/17 |
| 2,823,011 | 2/1958 | Jones | 254/15 |
| 3,049,336 | 8/1962 | Profffit | 254/17 |
| 3,331,584 | 7/1967 | Schwartz . | |
| 3,779,515 | 12/1973 | Larias et al. | 254/16 |

*Primary Examiner*—Robert C. Watson

*Attorney, Agent, or Firm*—Welch & Katz, Ltd.

[57] ABSTRACT

A tool for setting a board on a joist, the tool includes a generally vertically extending elongated bar and a hook member attached to a lower end of the bar. The lower end and the hook member form an engaging assembly for removably engaging the lower end portion of the bar to the joist. The hook member includes a lower member attached to and extending laterally outward from a lower end portion of the bar and a guiding member attached to and extending generally vertical upward from an outer end of said the lower member. At least one pointed member is fixedly attached to and extends vertically upward from the upper surface of the first member. The pointed member includes a pointed upper end to engage the joist and establish a fulcrum point between the bar and the joist. After the tool has been engaged with the joist the bar may be rotated to contact the board and urge the board into a desired position relative to the joist.

18 Claims, 1 Drawing Sheet

BOARD SETTING TOOL

FIELD OF THE INVENTION

This invention relates to tools for constructing structures having wooden elements, and more particularly, to a tool for positioning boards for attachment to an underlying support structure.

BACKGROUND OF THE INVENTION

During the construction of structures having wooden elements, many occasions arise whereby boards or other wooden elements must be positioned adjacent another board before attachment to an underlying support such as a beam, rafter or joist. In addition, in several instances, the boards must be tightly pressed against the adjacent board before attachment to the underlying support. For example, when constructing roofing, plywood must be attached to the roofing rafter, and the local building codes may require that the edges of the plywood be tongued and grooved and that adjacent plywood pieces be forced together so that the tongue makes a close joint with the groove on the adjacent board.

The usual manner of forcing adjacent boards together before attachment is to lay the unattached board next to a board which has been previously attached to the underlying support. The unattached board is then forced into firm engagement with the adjacent board typically by striking an exposed edge of the board or plywood, opposite the edge being forced into firm engagement, with a sledge hammer or maul. After the board has been forced into firm engagement, the board must be maintained in that position until nails or other attachment elements can be driven into the board to attach it to the underlying support.

This method of forcing the board into firm engagement and maintaining that position has several drawbacks. One drawback is that striking the edge of the board may damage the edge which in the case of boards which will be visible, such as patio decks, causes the edges to be scarred and unsightly. Also, the force generated by striking the edge of the board being attached is transmitted through to the boards previously attached and may damage the edges of the previously attached boards. More significantly, the cumulative effects of the forces transmitted to an earlier attached board by the striking of a number of later attached boards may cause significant damage to the earlier attached board.

Another drawback of this method is that the maintaining of the board in the firm engagement position until attachment can be made typically requires the task to be employed with two people, one to maintain the board in the firm engagement position and the other to nail the board to the underlying support.

It is therefore an object of the present invention to provide a device which may force a board into firm engagement with an adjacent board.

It is another object of the present invention to provide a device which maintains a board in firm engagement with an adjacent board to allow attachment of the board to an underlying support.

Another object of the present invention is to provide a device which presses a board into firm engagement with an adjacent board without significantly damaging the edge of the board.

It is a still further object of the present invention to provide a device which can be operated by one person to press a board into firm engagement with an adjacent board, and maintain that board in firm engagement until attachment to an underlying support can be made.

SUMMARY OF THE INVENTION

Accordingly, a tool for setting a board on a support is provided, the tool includes a generally vertically extending elongated bar and a hook member attached to a lower end of the bar. The lower end of the bar and the hook member form an engaging assembly for removably engaging the lower end portion of the support and forming a fulcrum point between the bar and the support. The hook member includes a lower member attached to and extending laterally outward from a lower end of the bar and a guiding member attached to and extending generally vertical upward from an outer end of said the lower member. At least one pointed member is fixedly attached to and extends vertically upward from the upper surface of the first member. The pointed member includes a pointed upper end to engage the support and establish the fulcrum point between the bar and the support.

More particularly, the pointed member includes a bolt which extends upward through the lower member. The bolt has a sharpened upper end to form the pointed upper end. The guiding member includes an angled inner surface to guide the support into engagement with the engaging assembly.

The tool may also include a plate which is attached to the bar above the engaging assembly to provide a surface for contacting the edge of the board. The contacting plate being generally aligned with the lower member and having a horizontally extending upper edge to provide a surface for applying a downward force to the tool so that the bolt may be disengaged from the support.

DESCRIPTION OF THE PREFERRED EMBODIMENTS

Figure 1:
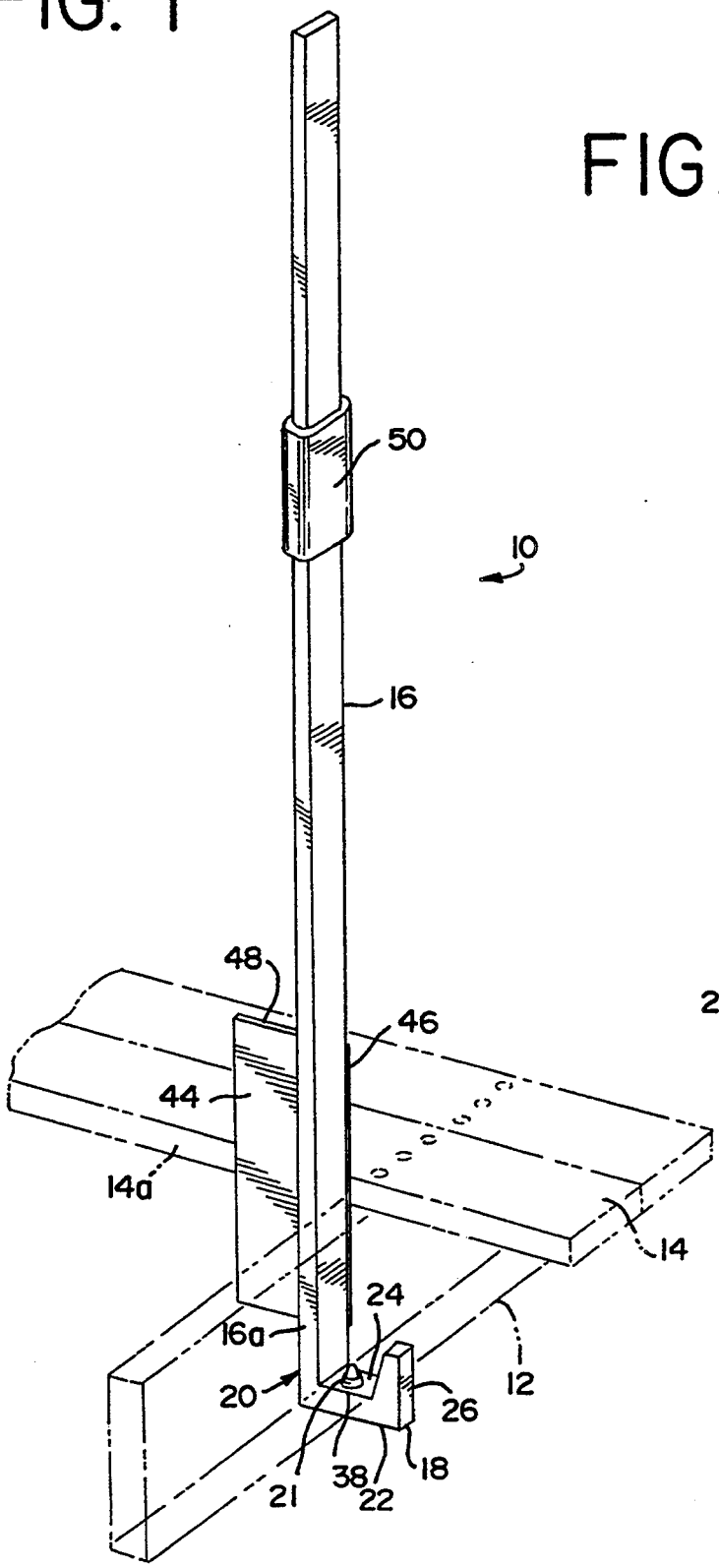
FIG. 1, is a front elevational view of the tool of the present invention shown secured to an underlying support.

Referring to FIG. 1, a preferred embodiment of the board setting tool of the present invention is generally indicated at 10. The tool is shown removably connected to a support such as a joist 12, shown in shadow, and bearing against an edge 14*a* of a board 14.

The tool 10 includes an elongated vertically or upward extending hollow rigid bar 16 with a polygonal, preferably hollow rectangular, periphery. The hollow configuration strengthens the bar 16 to prevent the bending of the bar if a torque is applied along the length of the bar. Although the bar 16 is preferably straight, other shapes such as a curved bar are also contemplated. Rigidly connected to a lower end 16*a* of the bar 16, is a hook member 18. The hook member 18 and lower end 16*a* of the bar 16 form an engaging means 20 for removably engaging the tool 10 to the joist 12, thereby establishing a fulcrum point 21 between the tool and the joist. The hook member 18 includes a lower member 22 which extends outward from the lower end 16*a* of the bar. The lower member 22 has an upper surface 24 which is configured to closely conform to the lower edge surface of the joist 12. A guiding member 26 extends upward from the outer edge portion of the outward member 22.

Figure 2:
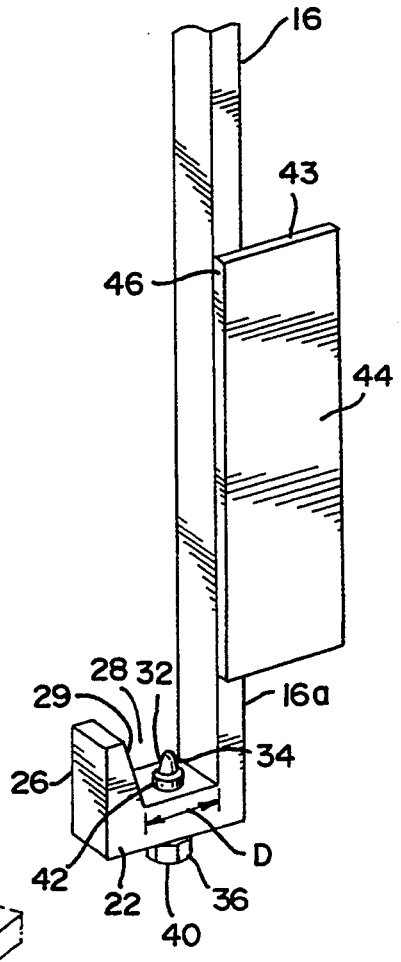
FIG. 2, is a partial front elevational view of the lower end of the tool of FIG. 1.

Referring to FIGS. 1 and 2, the lower end 16*a* of the bar 16, the lower member 22 and the guiding member 26 form a notch 28 which is configured to snugly receive a lower end portion of the joist 12. The notch 28 is also configured so that the joist is guided into a gripping engagement with the engaging means 20 upon upward movement of the tool 10 relative to the joist.

To guide the joist 12 into a gripping engagement, the guiding member 26 includes an inner surface 29 which is outwardly inclined relative to the bar 16. To provide the snug gripping engagement between the connecting means 18 and the joist 12, a distance D formed between the lower end of the bar 16 and the guiding member 26, closely adjacent the lower member 22, is slightly less than the thickness of the joist 12. For example, if the joist 14 has a thickness of $1\frac{1}{2}$ inches, the distance D may be $1\frac{3}{8}$ inches.

To engage the tool 10 to the joist 12 and thereby establish the fulcrum point 21, the engaging means 20 includes a pointed member 32. The pointed member 32 extends vertically through the lower member 22 and upward from the upper surface 24 of the lower member. The pointed member 32 includes an upward pointed end 34 which punctures the lower end of the joist 12.

In the preferred form, the pointed member 32 is a threaded bolt 36. The bolt 36 extends upward through a pair of vertically aligned openings 38 in the outward extending member 22. The bolt 36 includes a lower head 40 which contacts the lower member 22. To secure the bolt 36 to the lower member 22, a nut 42 threadingly engages the bolt and contacts the upper surface 24 of the lower member. The threads 43 on the bolt 36 act as barbs to maintain the engagement between the bolt and the joist 12.

The previously described arrangement of attaching the bolt 36 to the hook member 20 allows the bolt 36 to be interchangeable so that bolts of different lengths may be provided. Also, the described arrangement allows the bolt 36 to be replaced should the upper pointed end 34 become dull or damaged.

The tool 10 also includes an engaging plate 44 which is rigidly attached to the bar 16. The plate 44 is aligned with the hook member 18 and extends outward from the bar 16 in a direction opposite to the hook member. The engaging plate 44 distributes the contacting force between the tool 10 and board 14 over a section of the board to reduce any damage to the edge 14*a* of the board. The engaging plate 44 is positioned on the bar 16 relative to the lower member 22 and has a height so that the tool 10 can be used on joist 12 of different heights and yet the plate 44 will engage the edge of the board 14. An inner engage 46 of the plate 44 is aligned with the edge of the bar 16 opposite the direction of extension of the plate so that the bar may be positioned closely adjacent to the joist 12.

The engaging plate 44 also acts as a means for disengaging the engaging means 18 from the joist 12. To provide this disengaging function, the plate 44 includes an upper edge 48 which extends generally horizontal or normal to the elongation direction of the bar 16. The upper edge 48 provides a on which the user may apply a downward directed force to the 10 to disengage the pointed member 32 from the joist 12.

Although the plate may reduce the damage caused by the pressing of the bar 16 against the upper edge 14*a* of the board 14, there may still be occasions when the needed contact force will cause a depression to be formed in the edge 14*a*. On such occasion, the bar 16 is tilted so that the engaging means 20 engages the joist 12 at a point beneath the board 14. With the tilted bar 16, the contact point between the bar 16 and edge 14*a* of the board 14 is on the underside of the edge so that if a depression is formed in the edge, the depression is not noticeable from the top surface of the board. The upward extension of the bolt 36 relative to the upper surface 24 of the outward extending member 22 causes the bolt to engage the joist even when the bar 16 is tilted to establish the fulcrum point.

A handle 50 is attached to and circumscribes the bar 16 upwards of the plate 44. The handle 50 is preferably made of an elastomeric material to provide a cushion for the user.

In use, the user places the board 14 closely adjacent an adjacent board which has been previously attached to the joist 12. The user positions the tool 10 so that the bar 16 abuts the edge 14*a* of the board, and the notch 28 is aligned with and below the joist 12. The bar 16 is positioned generally vertical or inclined slightly either away or toward the user depending on the space constraints.

The user then moves the tool 10 upward. As the tool 10 is moved upward, the lower end 16*a* of the bar 16 and the angled guiding member 26 guides the lower end of the joist into the pointed end 34 of the bolt 36. The tool 10 is moved upward until the lower member 22 contacts the joist 12 and the bolt 36 engages and the lower member to the joist thereby establishing the fulcrum point 21.

The user then pulls the bar 12 toward the board 14 until the engaging plate 44 contacts the edge 14*a* of the board and the tool 10 urges the board toward the adjacent board. Further movement of the bar 16 urges the board 14 toward the adjacent board because the tool 10 acts as a lever having the fulcrum point 21.

Because the pointed member 32 extends generally vertically upwards, the bar 16 may be rotated about the fulcrum point 21 and moved from one angular orientation relative to the joist to another angular orientation without slippage between the pointed member and the joist 16. If the pointed member 32 extended at too acute an angle relative to the lower member 22, the engaging means 18 may slip when the bar 16 is angled in a direction opposite to the angle of the pointed member.

The board 14 is urged toward the adjacent board by the contact force between the plate 44 and the board until the board is placed in a desired position. The user may then use one hand and grasp the handle 50 to maintain a force on the tool 10 so that the board 14 is maintained in the desired position. The other hand of the user is then available to complete the attachment of the board 14 to the joist 12 by employing a hammer, nail gun or other device.

A specific embodiment of the novel board setting tool according to the present invention has been described for the purposes of illustrating the manner in which the invention may be made and used. It should be understood that implementation 18 of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

I claim:

1. A tool for setting a board on a joist comprising:

an elongated bar; and a hook member rigidly attached to a lower end of said bar, said hook member and said lower end forming a means for removable engaging the lower end portion of the joist, said hook member including, a first member attached to and extending laterally outward from said lower end of said bar, a second member attached to and extending generally vertical upward from an outer end of said first member, at least one pointed member fixedly attached to and extending vertically upward from said upper surface of said first member, said pointed member including a pointed upper end to engage the joist and establish a fulcrum point, said second member includes an angled inward surface to guide the joist into engagement with said engagement means.

2. The tool of claim 1 wherein said pointed member is removably attached to said first member.

3. The tool of claim 2 wherein said pointed member includes a bolt having a sharpened upper end, said bolt extending vertically through said lower member.

4. The tool of claim 1 wherein the horizontal spacing between said bar and said second member adjacent said first member is less than the thickness of said joist.

5. The tool of claim 1 further including means attached to said bar for forming a surface extending normally to said bar upon which a downward force may be applied to said bar to disengage said engagement means from the joist.

6. The tool of claim 5 wherein said surface forming means includes a plate attached to said bar, said plate having an upper edge extending generally normal to said bar.

7. The tool of claim 1 further including a plate attached to said bar above said engaging means and extending from said bar in a direction generally aligned with said first member.

8. The tool of claim 7 wherein said plate includes a vertically extending edge, said plate being attached to said bar so that said vertical edge is aligned with a vertically extending edge of said bar.

9. The tool of claim 1 further including a handle attached to said bar above said engaging means.

10. The tool of claim 1 wherein said pointed member has a lateral surface forming thread means for maintaining the engagement between the joist and said pointed member.

11. A tool for setting a board on a joist comprising:

a generally vertically extending elongated bar; and a means for removable engaging the lower end portion of the joist, said engaging means being attached to a lower end of said bar and including, a first member attached to and extending laterally outward from said lower end of said bar, a second member attached to and extending generally vertical upward from an outer end of said first member, at least one bolt having a sharpened upper end, said bolt extending vertically through said lower member and extending vertically upward from said upper surface of said first member, said pointed upper end engaging the joist to establish a fulcrum point, said second member including an angled inward surface to guide the joist into engagement with said bolt; and a plate attached to said bar above said engaging means and extending from said bar in a direction generally aligned with said first member, said plate having an upper edge extending generally normal to said bar.

12. The tool of claim 11 further including a handle attached to said bar above said engaging means.

13. The tool of claim 11 wherein said bolt is threaded over the surface of said bolt extending upward from said first member.

14. A tool for setting a board on a joist comprising:

an elongated bar;

a hook member rigidly attached to a lower end of said bar, said hook member and said lower end forming a means for removable engaging the lower end portion of the joist, said hook member including, a first member attached to and extending laterally outward from said lower end of said bar, a second member attached to and extending generally vertical upward from an outer end of said first member, at least one pointed member fixedly attached to and extending vertically upward from said upper surface of said first member, said pointed member including a pointed upper end to engage the joist and establish a fulcrum point; and means fixedly attached to said bar for forming a surface extending normally to said bar upon which a downward force may be applied to said bar to disengage said engagement means from the joist.

15. The tool of claim 14 wherein said surface forming means includes a generally vertically extending plate fixedly attached to said bar, said plate having an upper edge forming said normally extending surface means.

16. The tool of claim 15 wherein said plate is attached to said bar to allow said bar to abuttingly extend along a vertically extending surface of the joist.

17. The tool of claim 16 wherein said plate includes a vertically extending edge, said plate being attached to said bar so that said vertical edge is aligned with a vertically extending edge or said bar.

18. The tool of claim 14 wherein said surface forming means extends outward from said bar in only one direction.

* * * * *